US008931935B2

(12) United States Patent
Lin et al.

(10) Patent No.: US 8,931,935 B2
(45) Date of Patent: Jan. 13, 2015

(54) AIR COOLING LED LAMP

(71) Applicant: UniLED Lighting TW., Inc., New Taipei (TW)

(72) Inventors: Ming-Te Lin, New Taipei (TW); Ming-Yao Lin, New Taipei (TW); Heng Qiu, Kaohsiung (TW); Po-Cheng Yang, Taipei (TW)

(73) Assignee: UniLED Lighting TW., Inc., New Taipei (TW)

( * ) Notice: Subject to any disclaimer, the term of this patent is extended or adjusted under 35 U.S.C. 154(b) by 0 days.

(21) Appl. No.: 14/093,373

(22) Filed: Nov. 29, 2013

(65) Prior Publication Data

US 2014/0292175 A1 Oct. 2, 2014

Related U.S. Application Data

(63) Continuation-in-part of application No. 13/919,486, filed on Jun. 17, 2013, which is a continuation-in-part of application No. 13/853,647, filed on Mar. 29, 2013.

(51) Int. Cl.
*F21V 29/00* (2006.01)

(52) U.S. Cl.
CPC ..... *F21V 29/004* (2013.01)
USPC ..... 362/373; 362/249.02; 313/46

(58) Field of Classification Search
CPC ..... F21Y 2111/005; F21Y 2111/007; F21Y 2101/02; F21Y 2105/001; F21Y 2101/00; F21V 29/004; F21V 29/2206; F21K 9/00; F21S 48/328; F21S 48/215; F21S 48/115; F21S 48/321; F21S 48/32; H01L 51/529; H01L 23/367; H01L 31/0521; H01L 2933/0075
USPC ..... 362/373; 313/46
See application file for complete search history.

(56) References Cited

U.S. PATENT DOCUMENTS

| | | | | |
|---|---|---|---|---|
| 2009/0040759 | A1* | 2/2009 | Zhang et al. | 362/249 |
| 2009/0323348 | A1* | 12/2009 | Shuai et al. | 362/294 |
| 2011/0109217 | A1* | 5/2011 | Kang et al. | 313/46 |
| 2012/0057364 | A1* | 3/2012 | Kishimoto et al. | 362/538 |
| 2013/0003376 | A1* | 1/2013 | Phipps et al. | 362/249.02 |
| 2014/0001956 | A1* | 1/2014 | Ter Weeme et al. | 315/113 |

* cited by examiner

*Primary Examiner* — Donald Raleigh
(74) *Attorney, Agent, or Firm* — Lowe Hauptman & Ham, LLP

(57) ABSTRACT

An air cooling LED lamp is disclosed. The lamp has air passages for natural air flow for cooling the lamp without using any electric fan to reduce electric energy consumption. The air passages still work for natural air cooling for the lamp when the lamp is configured either in a top down position or in a lateral position.

19 Claims, 23 Drawing Sheets

Fig.3C
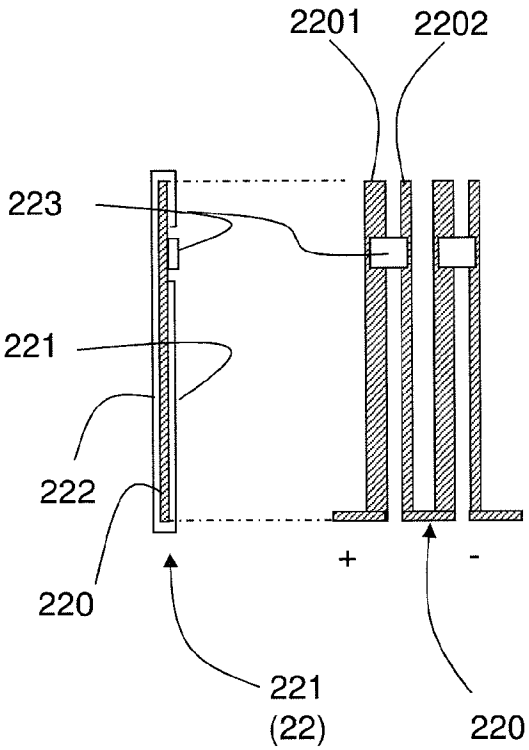
Fig.3B
Fig.3A
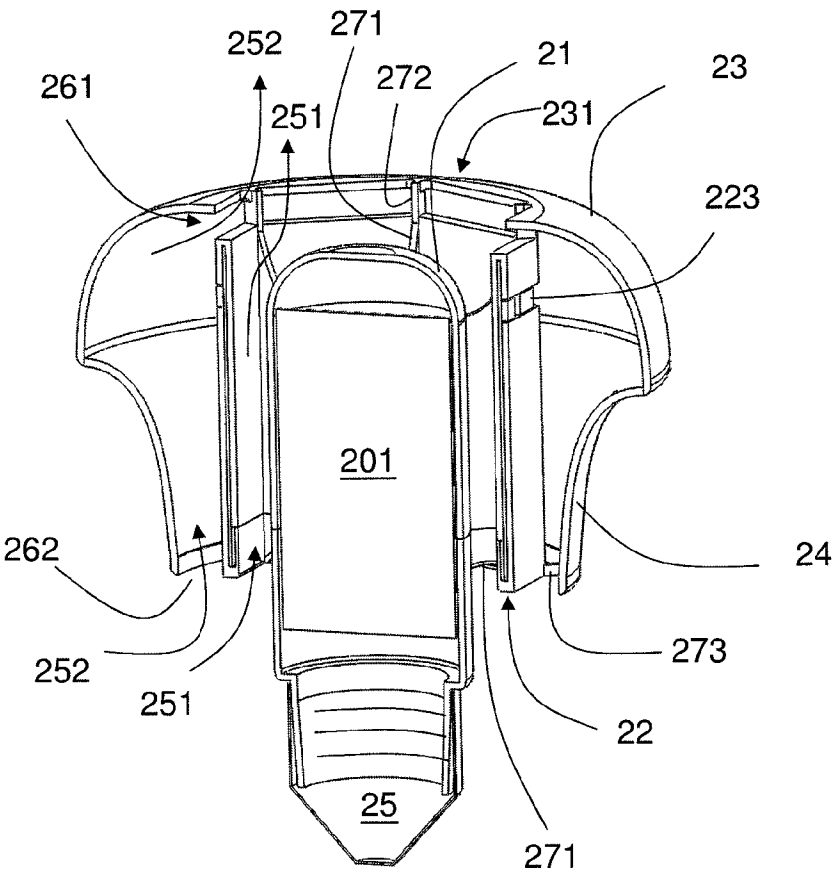

AIR COOLING LED LAMP

This application is a continuation-in-part application of U.S. application Ser. No. 13/919,486 filed Jun. 17, 2013 which is a continuation-in-part application of U.S. application Ser. No. 13/853,647 filed Mar. 29, 2013, the disclosure of which is incorporated by reference herein in its entirety.

BACKGROUND

1. Technical Field

The present invention relates to a lamp, especially an air cooling LED lamp which has air passages for natural cooling the lamp without using an electric fan.

2. Description of Related Art

FIG. 1 is a prior art

FIG. 1 shows a prior art, it discloses an LED lamp with an electric fan for cooling the lamp. The LED 5 is mounted on a support 4. Cooling air 8 is guided through openings 11 in the lamp base 2 to electric fan 6 and blown out through a cavity 12 of the support 4 upward as discharge stream 9. Cooling fins 13 for reinforced cooling of the support 4 are arranged in cavity 12. By cooling the support 4, the power demand of the LED lamp can be increased.

The deficiency of the prior art is to use an electric fan 6 for the cooling. Running of the electric fan 6 consumes electric energy. It is desired to develop a natural cooling system without using an electric fan so as to reduce electricity consumption.

BRIEF DESCRIPTION OF THE DRAWINGS

FIG. 3A is a section view of FIG. 2

FIG. 3B is a side view of the light unit of FIG. 3A

FIG. 3C is a front view of the metal strip of FIG. 3B

DETAILED DESCRIPTION OF THE INVENTION

This invention uses air passages for cooling the led lamp without using any electric fan so that the present invention is a green product which reduces electric energy consumption.

Figure 1:
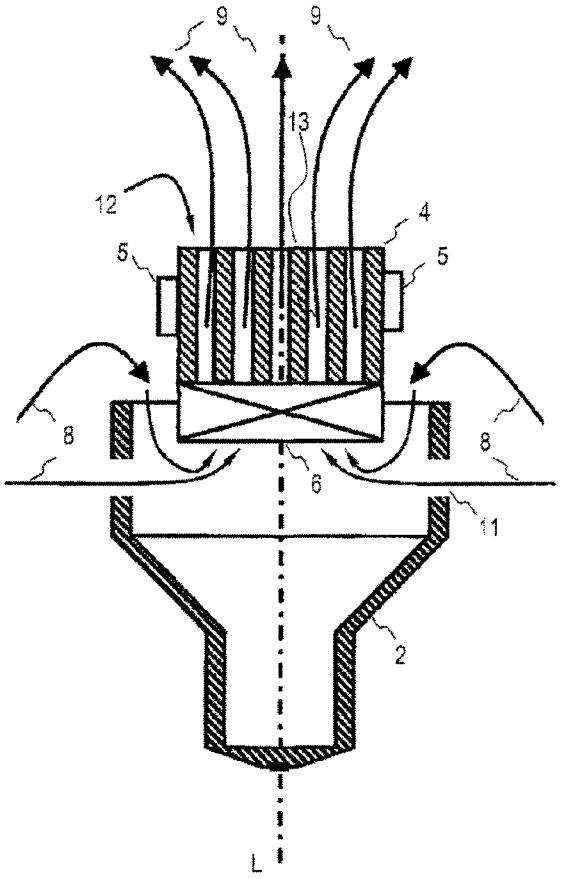
Fig.1 Prior Art
FIG. 1 is a prior art
Figure 2:
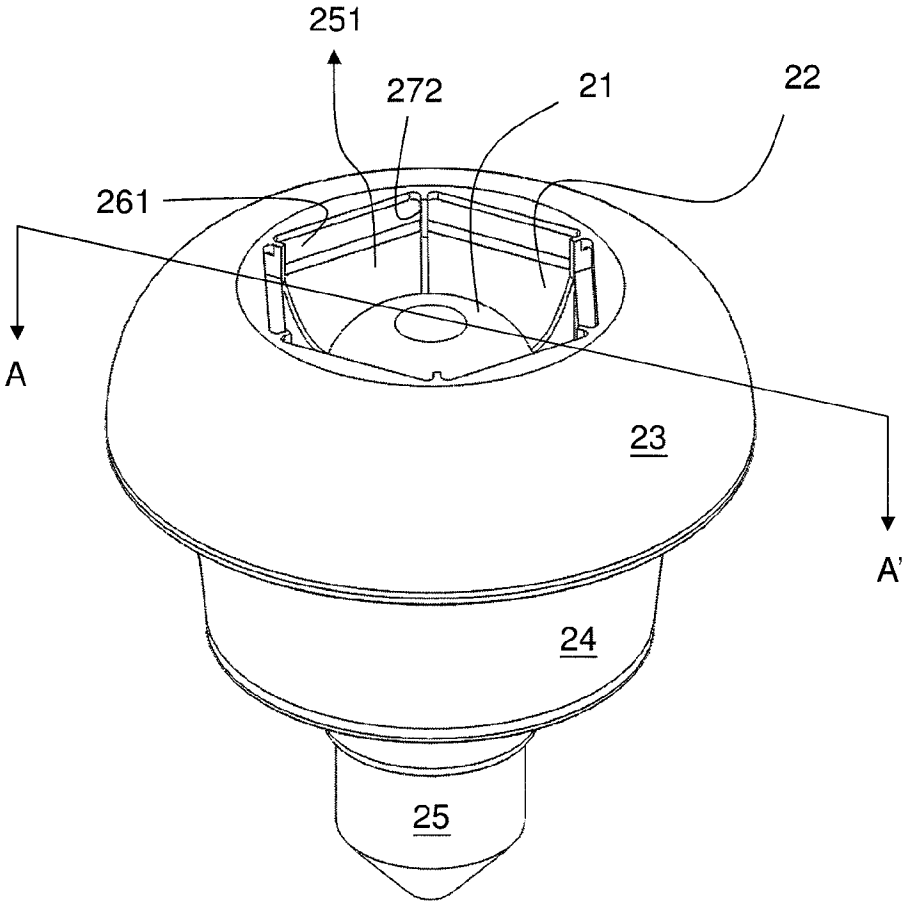
FIG. 2 is a first embodiment according to the present invention

FIG. 2 is a first embodiment according to the present invention

FIG. 2 shows an LED lamp, which has a central tube 21 for housing circuit board and other electronic elements. A circular light wall 22 encloses the central tube 21. An air passage 251 is formed between the central tube 21 and the light wall 22 for a natural air-flow bottom up. A lamp base 25 is configured on a bottom of the central tube 21 for being able to mount the lamp to a conventional lamp socket. A top gap 261 is configured on a top of the light wall 22 for air flow. Top rib 272 is used for fixing the position between the light wall and the transparent dome 23. A trumpet cup 24 is configured under the transparent dome 23.

FIG. 3A is a section view of FIG. 2

FIG. 3A is a section view of the lamp according to line AA' shown in FIG. 2. The section view shows a central tube 21 having circuit board 201 and other electronic elements (not shown) inside. A circular light wall 22 is composed of a plurality of light unit 221 that are configured side by side. The circular light wall 22 surrounds the central tube 21. Each of the light units 221 has a light source 223 mounted on a top end facing outward. A transparent dome 23 surrounds a top of the circular light wall 22 for modifying light beams of the light unit 221 before emitting. A central cavity 231 is configured on a top center of the transparent dome 23.

A first air passage 251 is formed between the central tube 21 and the circular light wall 22 for air flow. A trumpet cup 24 is configured under the transparent dome 23, surrounds lower part of the circular light wall 22. A top gap 261 is configured between a top end of the transparent dome 23 and a top end of the circular light wall 22. The top gap 261 communicates with the central cavity 231. A bottom gap 262 is configured between a bottom of the circular light wall 22 and a bottom of the trumpet cup 24. A second air passage 252 communicates between the top gap 261 and the bottom gap 262 for air flow.

An inner rib 271 is configured between the central tube 21 and the circular light wall 22 for fixing a position between the central tube 21 with reference to the circular light wall 22. An outer rib 273 is configured between the circular light wall 22 and a trumpet cup 24 for fixing a position between the circular light wall 22 and the trumpet cup 24. A top rib 272 is configured between a top end of the circular light wall 22 and a top end of the transparent dome 23 for fixing a position between the circular light wall 22 and the transparent dome 23.

FIG. 3B is a side view of the light unit of FIG. 3A

FIG. 3B shows that an LED is mounted on a top of the metal strip 220. A front side protection layer 221 coated on a front side of the metal strip 220 except an area for the LED 223 to mount. A back side protection layer 222 is coated on a back side of the metal strip 220.

FIG. 3C is a front view of the metal strip of FIG. 3B

FIG. 3C shows the structure of a metal strip 220 of the light unit 221. A pair of metal strips 2201, 2202 is parallel configured. An LED 223 is straddled on a top of the metal strips 2201, 2202.

Figure 4:
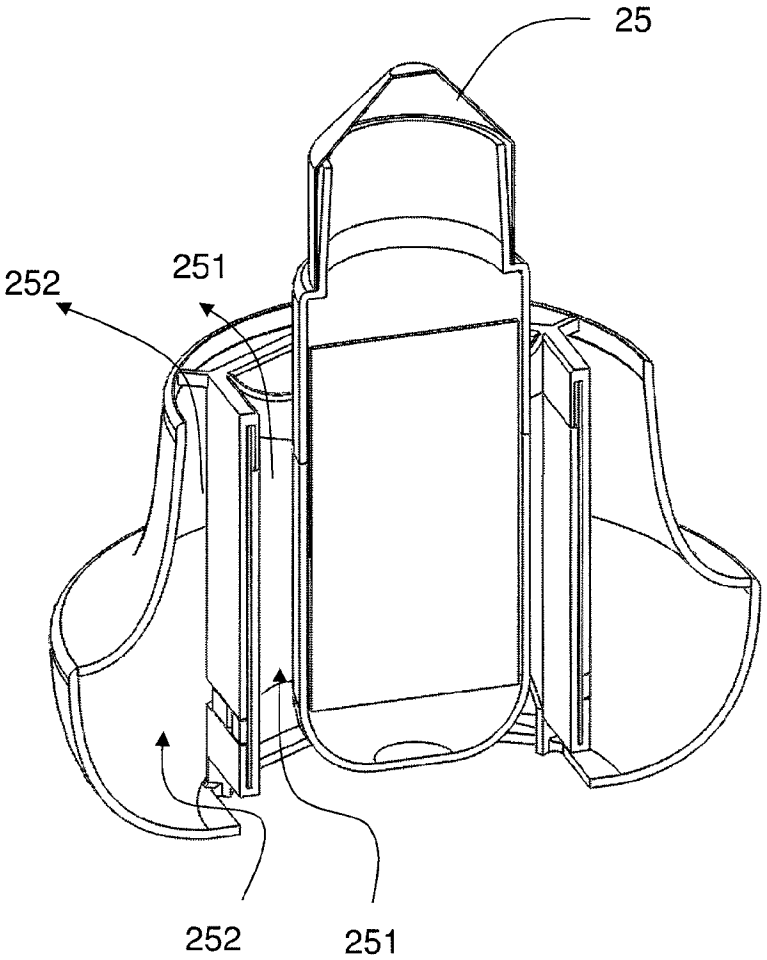
FIG. 4 is a reversed position of the lamp of FIG. 3A

FIG. 4 is a reversed position of the lamp of FIG. 3A

FIG. 4 shows when the lamp of FIG. 3A is configured in a reversed position, the first air passage 251 and the second air passage 252 still work for the air flow cooling bottom up.

Figure 5:
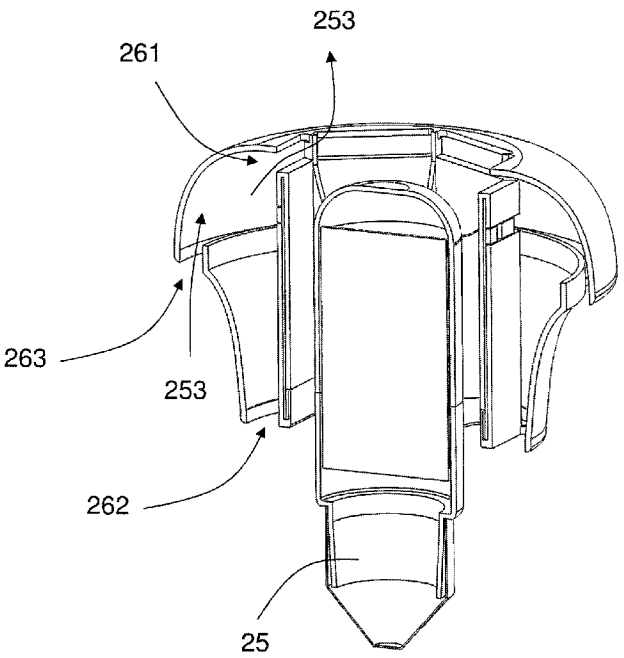
FIG. 5 is a second embodiment according to the present invention

FIG. 5 is a second embodiment according to the present invention

FIG. 5 is a modified lamp of FIG. 3A. FIG. 5 shows that a side gap 263 is configured between a bottom end of the transparent dome 23 and a top end of the trumpet cup 24. A third air passage 253 communicates between the side gap 263 with the top gap 261 for air flow.

Figure 6:
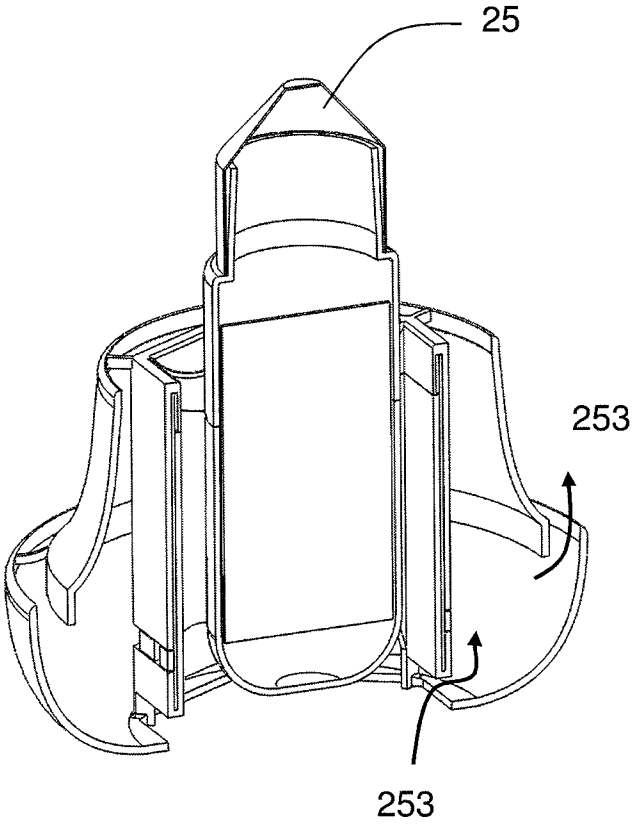
FIG. 6 is a reversed position of the lamp of FIG. 5

FIG. 6 is a reversed position of the lamp of FIG. 5

FIG. 6 shows when the lamp of FIG. 5 is configured in a reversed position, the third air passage 253 still work for the air flow bottom up.

Figure 7:
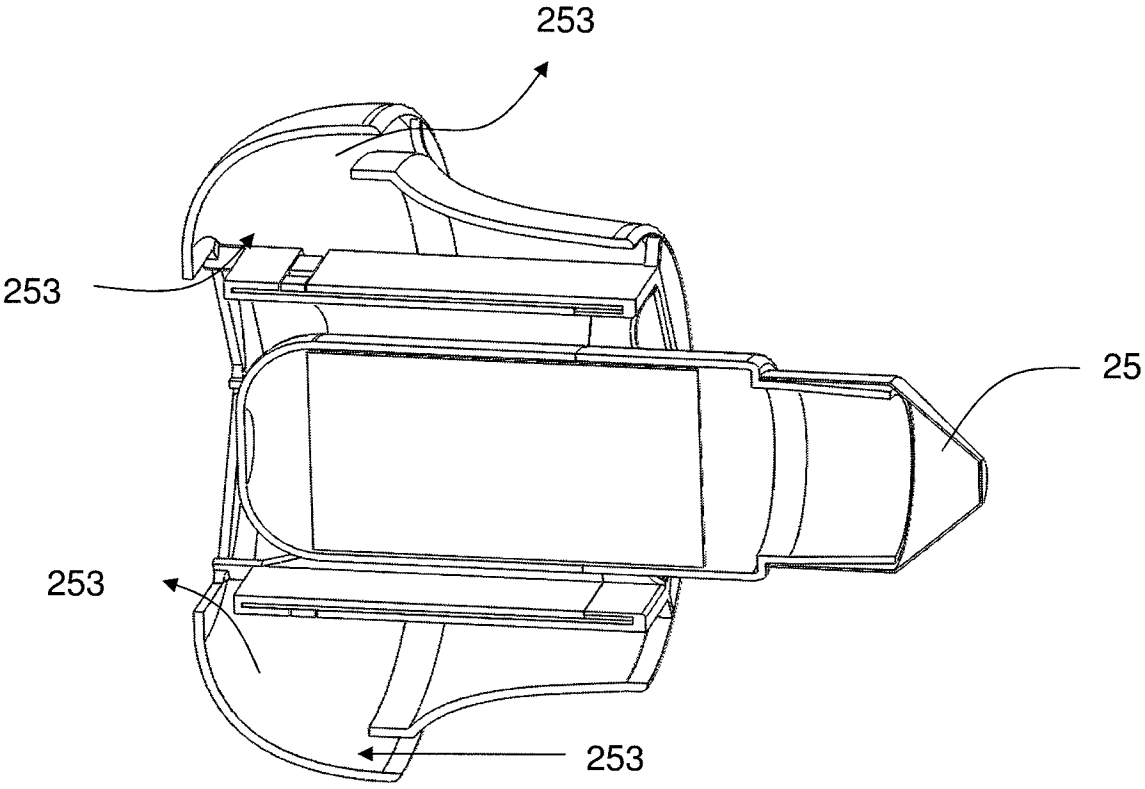
FIG. 7 is a lateral position of the lamp of FIG. 5

FIG. 7 is a lateral position of the lamp of FIG. 5

FIG. 7 shows when the lamp of FIG. 5 is configured in a lateral position, the third air passage 253 still work for the air flow bottom up.

Figure 8:
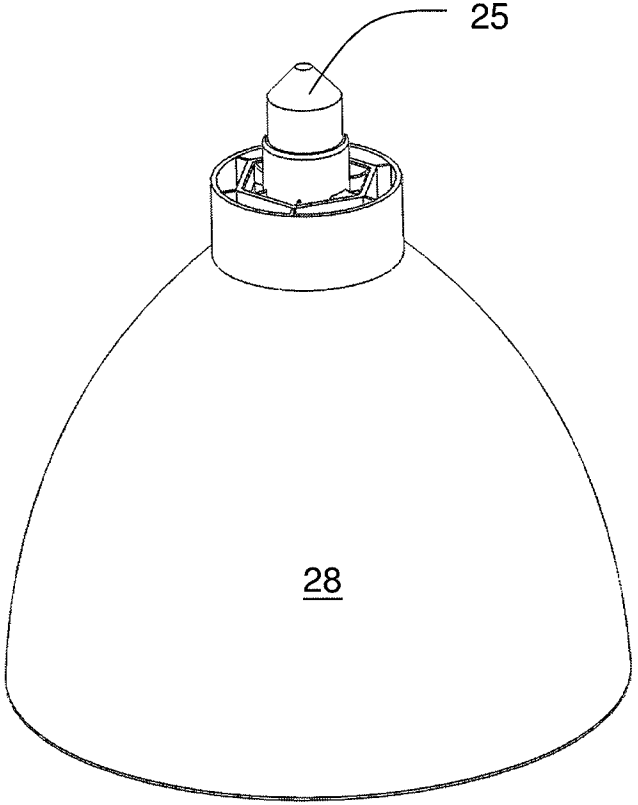
FIG. 8 is a modified embodiment according to the present invention

FIG. 8 is a modified embodiment according to the present invention

FIG. 8 shows that a reflection cup 28 is prepared to cover the lamp as a lampshade for modifying the light direction of the light source 223 before emitting.

Figure 9:
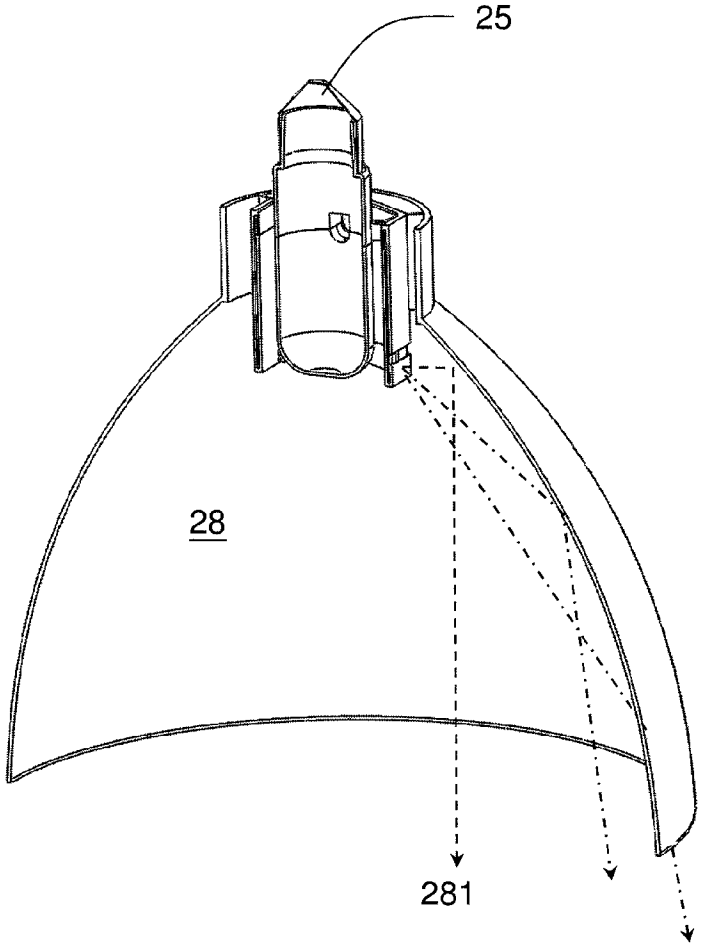
FIG. 9 is a section view of FIG. 8

FIG. 9 is a section view of FIG. 8

FIG. 9 shows the direction of the light beams 281 have been modified by the inner wall of the reflection cup 28 before the light beams exiting the lamp.

Figure 10:
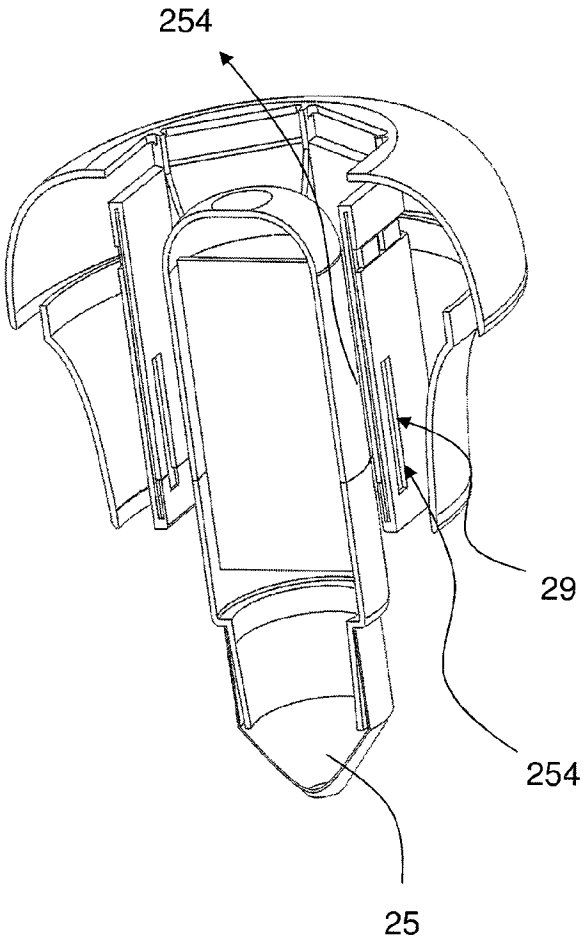
FIG. 10 is a modified lamp of FIG. 3A

FIG. 10 is a modified lamp of FIG. 3A

FIG. 10 shows that a slot 29 is configured passing through a lower portion of the light unit. A further air passage 254 is formed for air flow to enhance the cooling efficiency.

Figure 11:
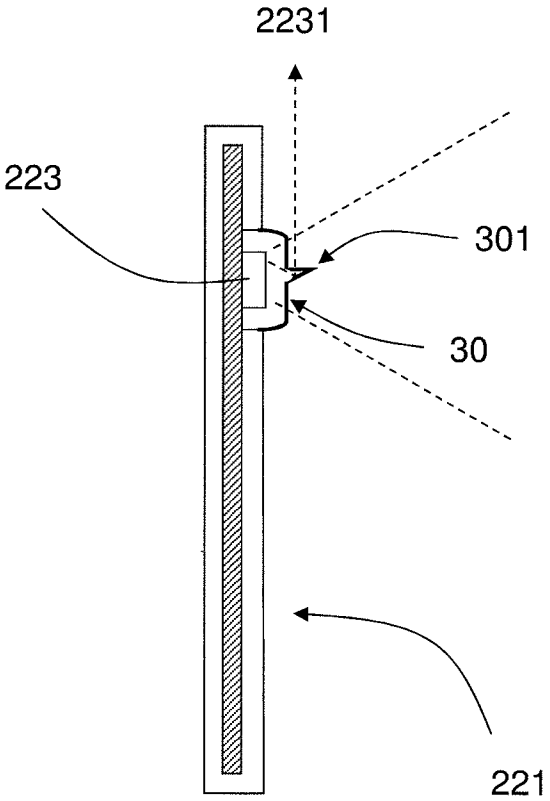
FIG. 11 is a modified light unit of FIG. 3B

FIG. 11 is a modified light unit of FIG. 3B

FIG. 11 shows that a lens 30 is configured in front of the light source 223 of the light unit 221 for compensating the light beams upward 2231. The lens 30 has a triangle extension 301 for reflecting light beam upward.

Figure 12:
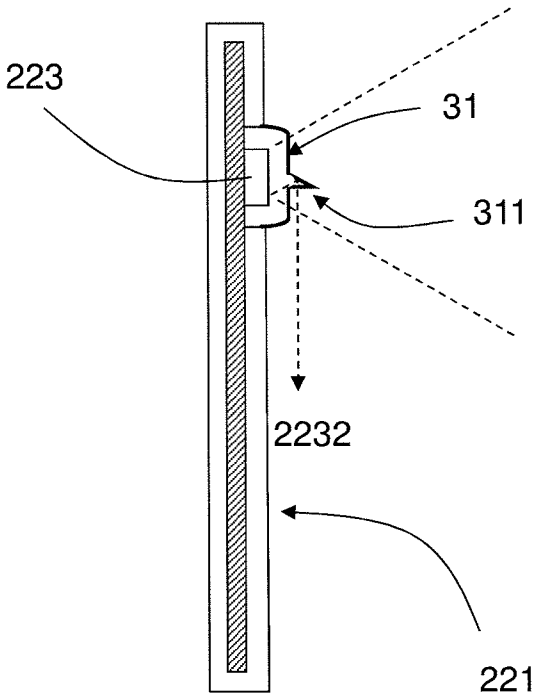
FIG. 12 is a further modified light unit of FIG. 3B

FIG. 12 is a further modified light unit of FIG. 3B

FIG. 12 shows that a lens 31 is configured in front of the light source 223 of the light unit 221 for compensating the light beams downward 2232. The lens has a triangle extension 311 for reflecting light beam downward.

Figure 13:
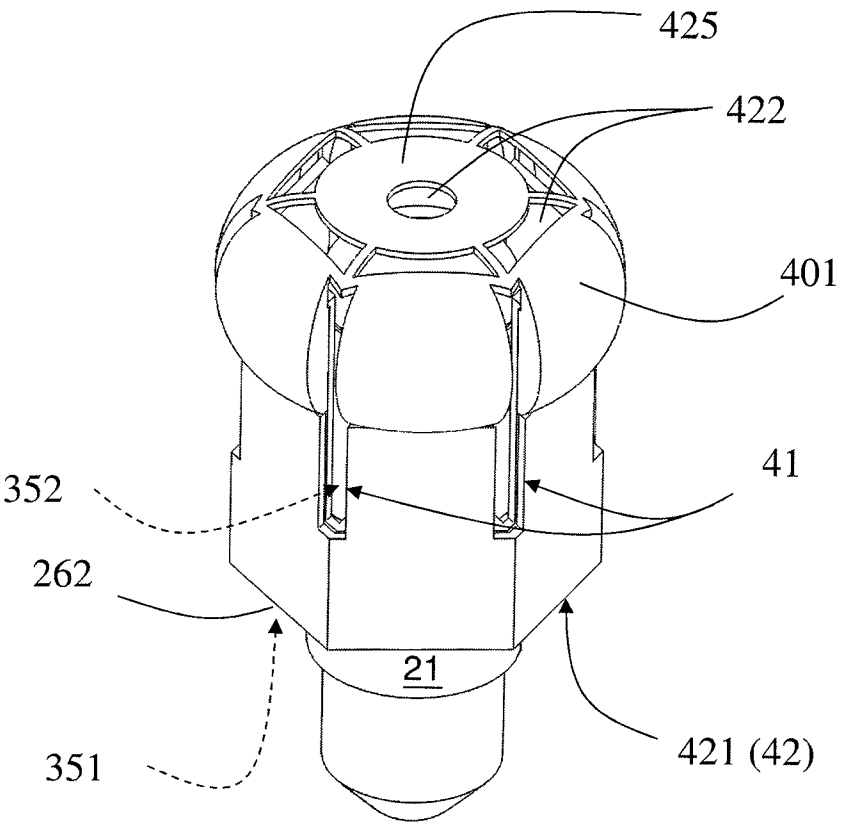
FIG. 13 is a third embodiment according to the presentation invention.

FIG. 13 is a third embodiment according to the presentation invention.

FIG. 13 shows that an air cooling LED lamp has a central tube 21 surrounded by a circular light wall 42. A top frame 425 connects the circular light wall 42 on top. A plurality of top opening 422 is made in the top frame 425 as an air outlet. A plurality bottom gap 262 is configured between a bottom of the central tube 21 and a bottom of the circular light wall 42. A first air passage 351 is configured between the central tube 21 and the circular light wall 42. The first air passage 351 communicates the top opening 422 and the bottom gap 262. The bottom gap 262 functions as a first air inlet. A plurality of side opening 41 is configured passing through the circular light wall 42. Each of the side opening 41 functions as a second air inlet. The opening 41 communicates with the first air passage 351. A second air passage 352 is formed between the side opening 41 and the top opening 422 for air flow. FIG. 13 shows that a six-facet polygon as an example, more or less number of light facet can be designed as the polygon light wall according to different application. The side opening 41 is made in a position between two neighboring light facets 421, in other words, the side opening 41 is made in the boundary or corner of neighboring light facet 421.

Figure 14:
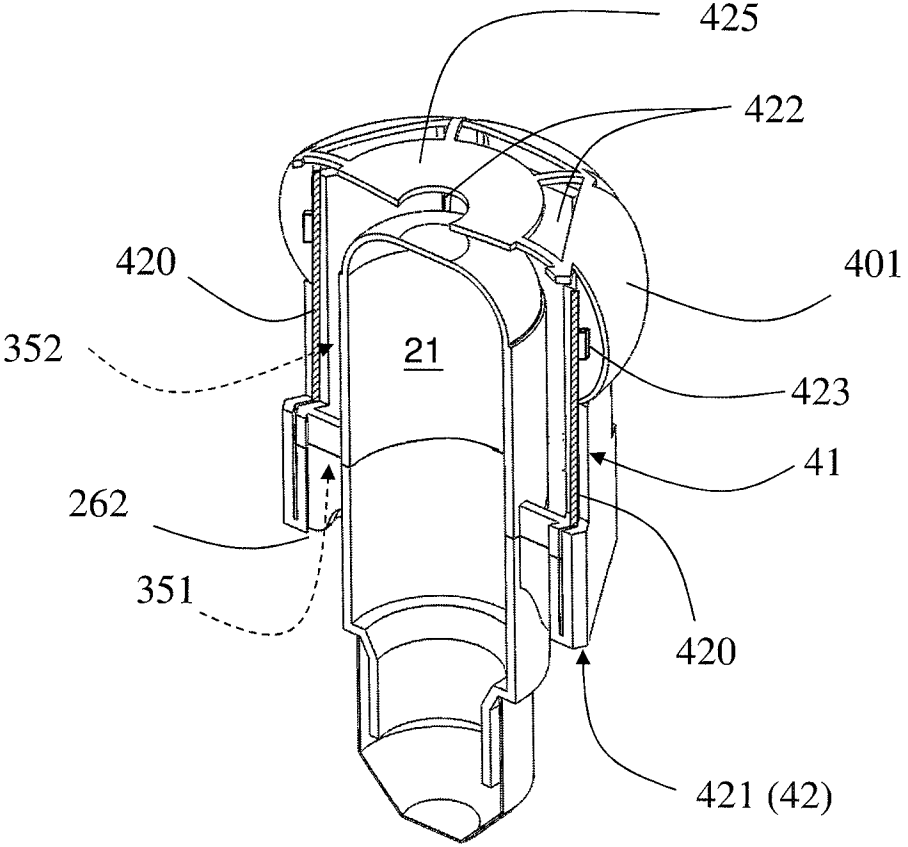
FIG. 14 is a section view of FIG. 13

FIG. 14 is a section view of FIG. 13

FIG. 14 shows that a metal strip 420 is partially sandwiched by protection layers in each light facet 421. An LED chip 423 is mounted on a top of the metal strip 420 to emit light beams facing outward to illuminate peripheral surrounding. A plurality of side opening 41 is made passing through the light wall 42. The side opening 41 is configured in a boundary or corner of neighboring light facets 421 of the polygon light wall 42. FIG. 14 shows that a side opening 41 is made beside the metal strip 420 in a section view. The protection cover 401 is configured in front of the LED chip 423. The first air passage 351 is configured between the bottom gap 262 and the top opening 422. The second air passage 352 is configured between the side opening 41 and the top opening 422.

Figure 15B:
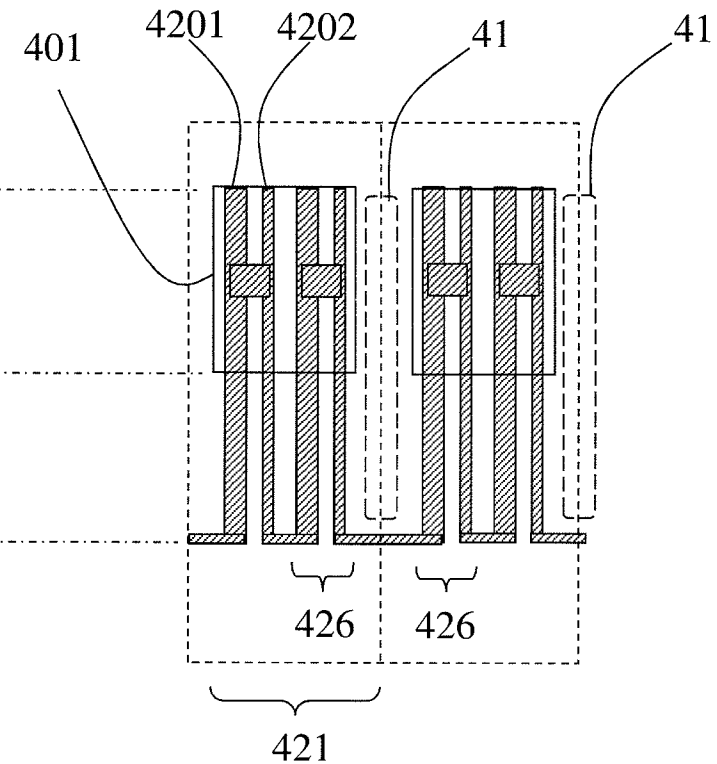
FIG. 15B is a front view of the light unit of FIG. 14
Figure 15A:
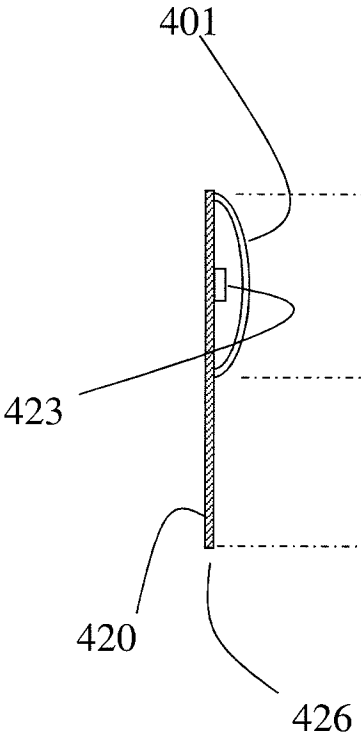
FIG. 15A is a side view of the light unit of FIG. 14

FIG. 15A is a side view of the light unit of FIG. 14

FIG. 15A shows that the light unit 426 has a LED chip 423 mounted on a top end of the metal strip 420, and a protection cover 401 is configured in front of the LED chip 423.

FIG. 15B is a front view of the light unit of FIG. 14

FIG. 15B shows that each light unit 426 has a pair of metal strips 4201, 4202. The LED chip 423 straddles on the two metal strips. The side opening 41 is made in a location between two neighboring light unit 426. Referring to FIG. 13 in view of FIG. 15B, each light facet 421 has two light units 426 inside; but this is an example only for describing the concept of the instant application; more or less light unit 426 can also be used in a single light facet 421.

Figure 16:
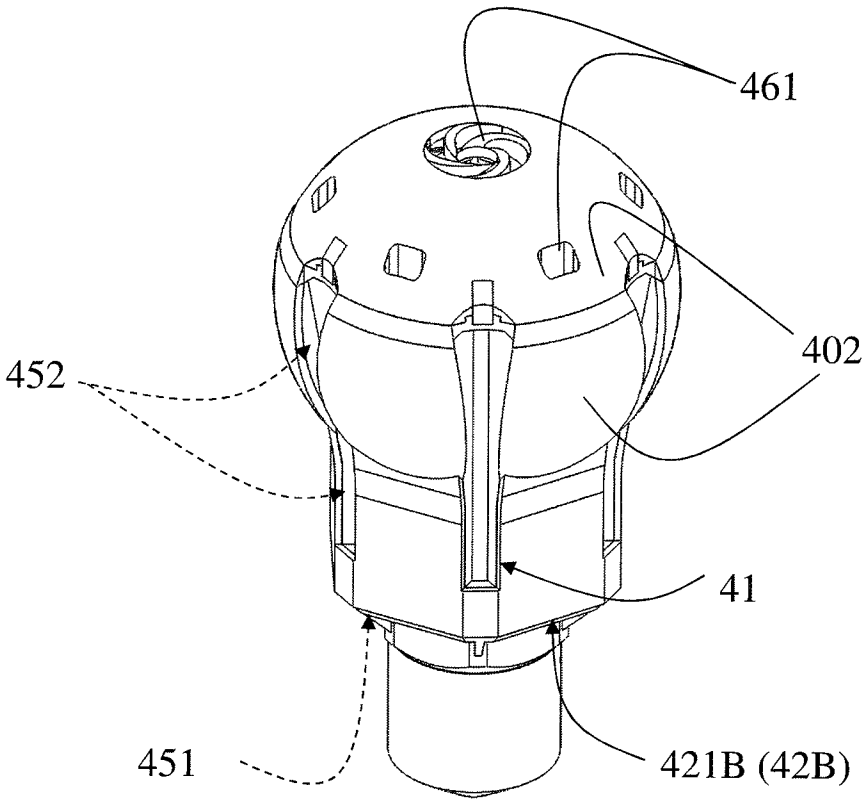
FIG. 16 is a fourth embodiment according to the presentation invention.

FIG. 16 is a fourth embodiment according to the presentation invention.

In comparison with FIG. 13, the design of FIG. 13 shows a flat top 425 with a plurality of openings 422 is configured. The design of FIG. 16 shows that a dome top protection cover 402 with a plurality of openings 461 is configured.

Figure 17:
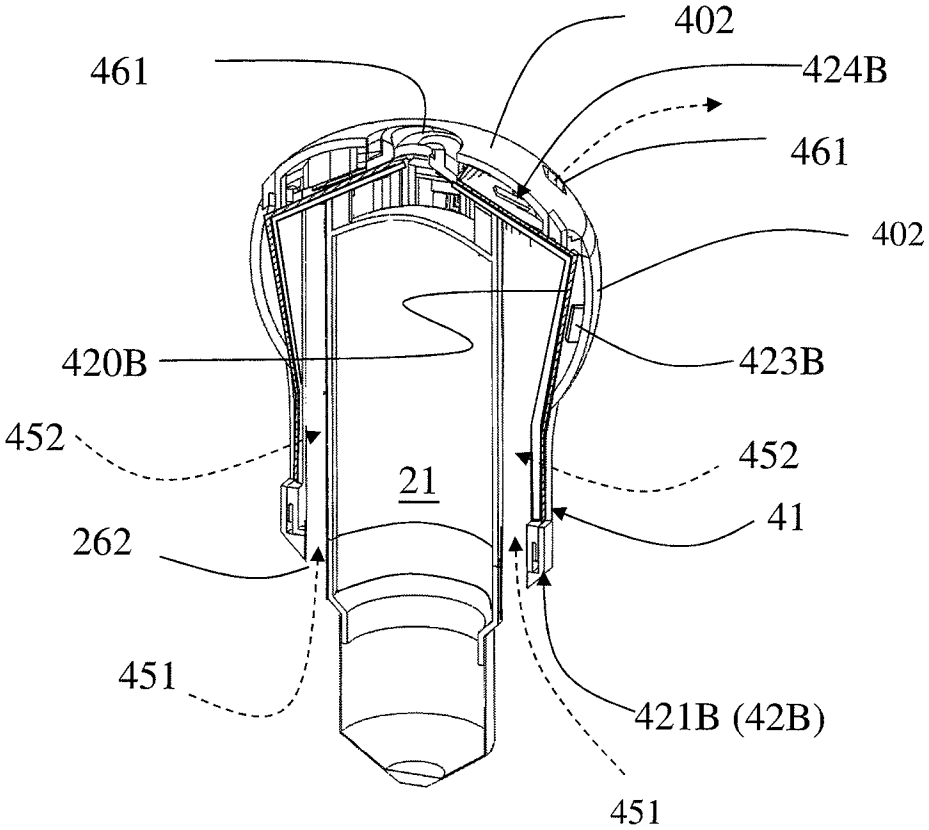
FIG. 17 is a section view of FIG. 16

FIG. 17 is a section view of FIG. 16

FIG. 17 shows that a curved metal strip 420B is partially sandwiched by protection layers in each light facet 421B. The curved metal strip 420B has a first facet facing peripheral oblique downward and a second facet facing peripheral oblique upward. A first LED chip 423B is mounted on the first facet in a position obliquely downward so as to emit light beams to illuminate obliquely downward. A second LED chip 424B is mounted on the second facet in a position obliquely upward so as to emit light beams to illuminate obliquely upward. The remaining structure is similar to the corresponding structure of the design of FIG. 13.

A first air passage 451 is configured between the central tube 21 and the circular light wall 42B. The first air passage 451 communicates the top opening 461 and the bottom gap 262. The bottom gap 262 functions as a first air inlet. A plurality of side opening 41 is configured passing through the circular light wall 42B. Each of the side opening 41 functions as a second air inlet. The opening 41 communicates with the first air passage 451. A second air passage 452 is formed between the side opening 41 and the top opening 461 for air flow.

Figure 18B:
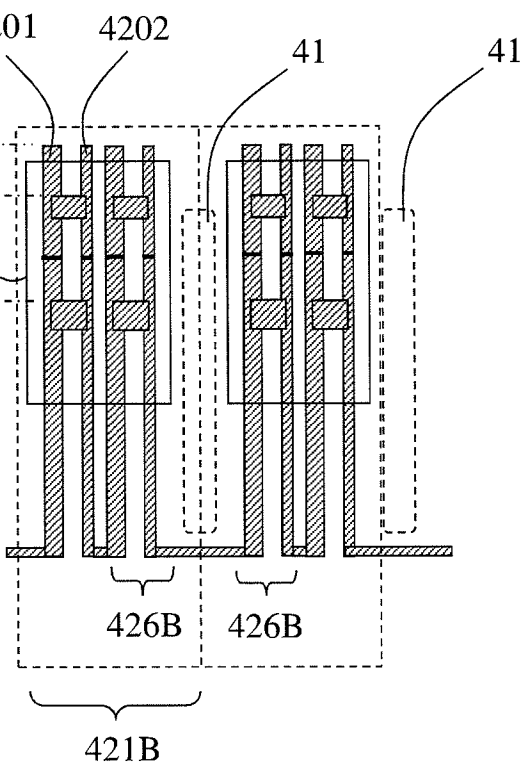
FIG. 18B is a front view of the light unit of FIG. 17
Figure 18A:
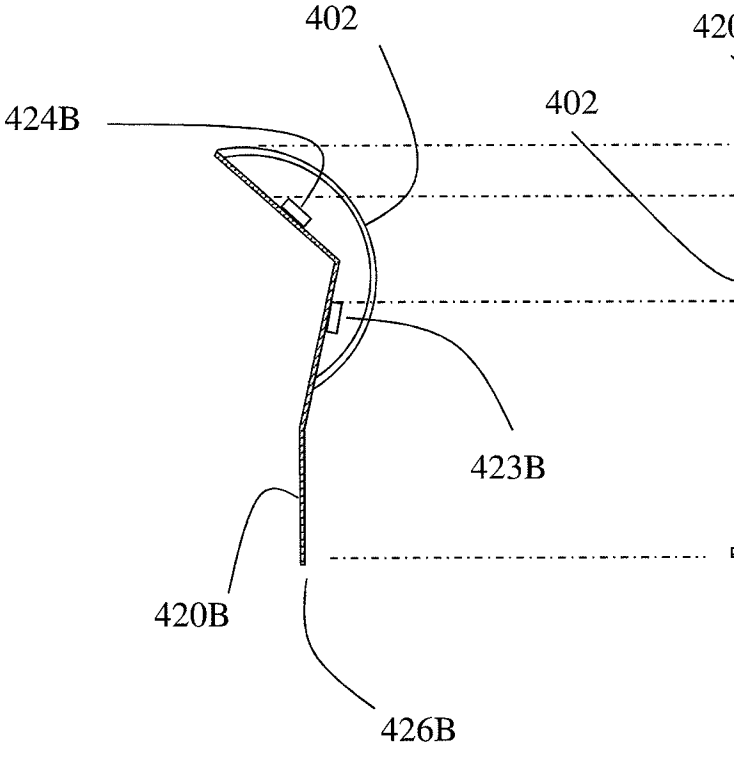
FIG. 18A is a side view of the light unit of FIG. 17

FIG. 18A is a side view of the light unit of FIG. 17

FIG. 18A shows that a first LED chip 423B is mounted on the first facet of the curved metal strip 420B, facing obliquely downward; and a second LED chip 424B is mounted on the second facet of the curved metal strip 420B, facing obliquely upward. A protection cover 402 is configured in front of both LED chips 423B and 424B.

FIG. 18B is a front view of the light unit of FIG. 17

FIG. 18B shows that each light unit 426B has a pair of metal strips 4201, 4202. Each of the first LED chip 423B and the second LED chip 424B, straddles on the two metal strips. The side opening 41 is made between two neighboring light unit 426B. Referring to FIG. 16 in viewing of FIG. 18B, each light facet 421 has two light units 426B inside; but this is an example only for describing the concept of the instant application; more or less light unit 426 can also be used in a single light facet 421.

Figure 19:
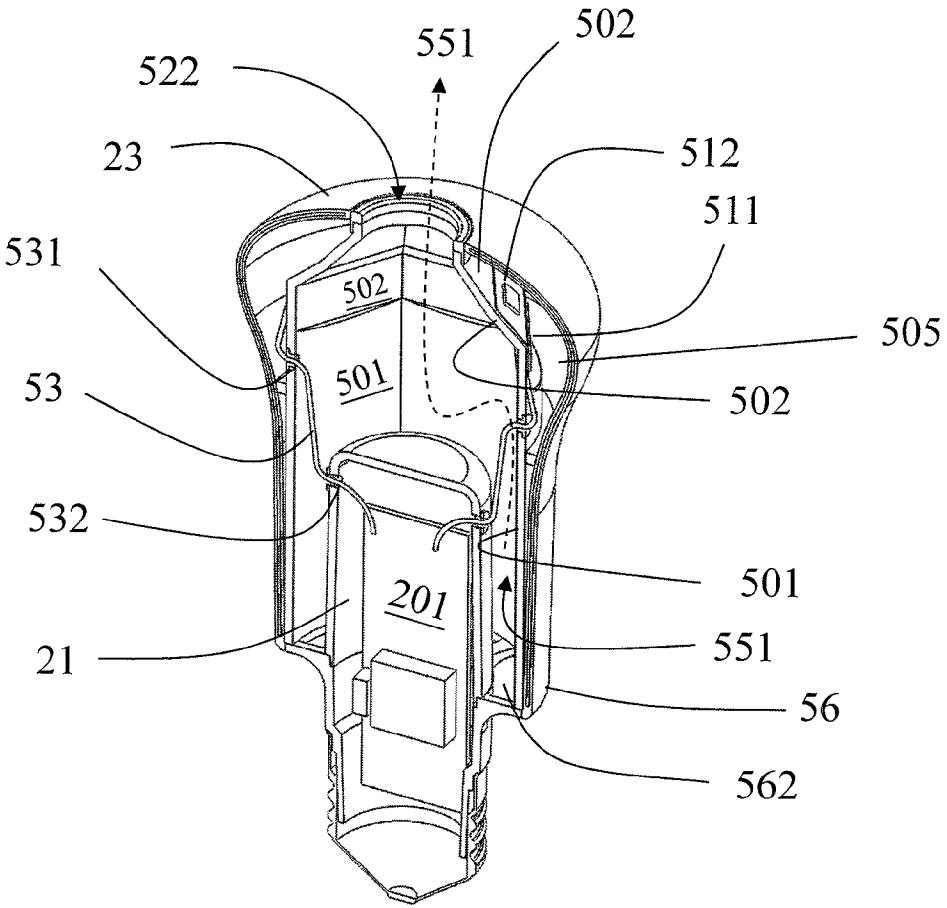
FIG. 19 is a fifth embodiment according to the presentation invention.

FIG. 19 is a fifth embodiment according to the presentation invention.

FIG. 19 shows that a central tube 21 is configured in the center of the lamp. A polygon metal tube 501 encloses the central tube 21. A circular air passage 551 is configured between the polygon metal tube 501 and the central tube 21. A flexible circuit board 511 is configured on the outer surface of the polygon metal tube 501. A plurality of LED is configured on a top surface of the flexible circuit board 511. A tapered metal tube 502 is configured on a top of the polygon metal tube 501. A top opening 522 is configured on a top of the tapered metal tube 502. A bottom opening 562 is configured on a bottom of the polygon metal tube 501 and the central tube 21. The circular air passage 551 communicates the top opening 522 and the bottom opening 562. A controlling circuit board 201 is configured inside the central tube 21. An electric wire 53 is electrically coupling the flexible circuit board 511 with the controlling circuit board 201. A first hole 531 is configured on the wall of the polygon metal tube 501 as a passage for the electric wire 53 to pass through. A second hole 532 is configured on the wall of the central tube 21 as a passage for the electric wire 53 to pass through. A transparent dome 23 is hermetically configured on a top of the lamp as a protection to the LEDs 223, the flexible circuit board 511 and the tab circuit board 512. A space 505 is formed between the transparent dome 23 and the LEDs 223.

Figure 20:
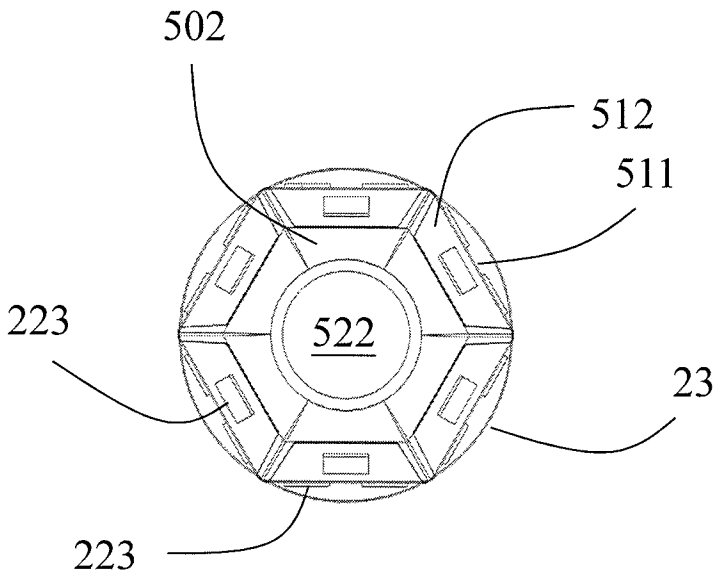
FIG. 20 is top view without the transparent dome.

FIG. 20 is top view without the transparent dome.

FIG. 20 shows that a hexagon is exemplified for the polygon metal tube 501. Other shapes such as a triangle, rectangle, pentagon . . . also can be used. The tapered metal tube 502 is configured on the top of the polygon metal tube 502. The flexible circuit board 511 with LED(s) is configured on the outer surface of the polygon metal tube 501. A tab circuit board 512 extends from the top side of the flexible circuit board 511 is configured on an outer surface of the tapered metal tube 502.

Figure 21:
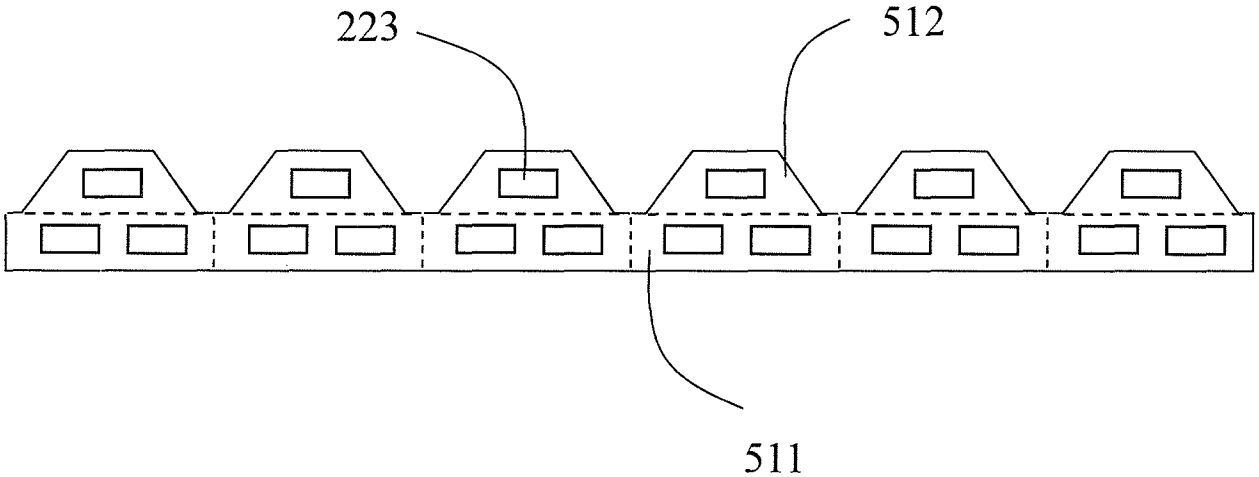
FIG. 21 is the circuit board with LED used in the fifth embodiment

FIG. 21 is the circuit board with LED used in the fifth embodiment

FIG. 21 show the circuit board used in the embodiment of FIG. 19. The flexible circuit board 511 has a plurality of LED mounted thereon. A plurality of tab circuit board 512 is extended from the top of the flexible circuit board 511. At least one LED is mounted on each of the tab circuit board 512.

Figure 22:
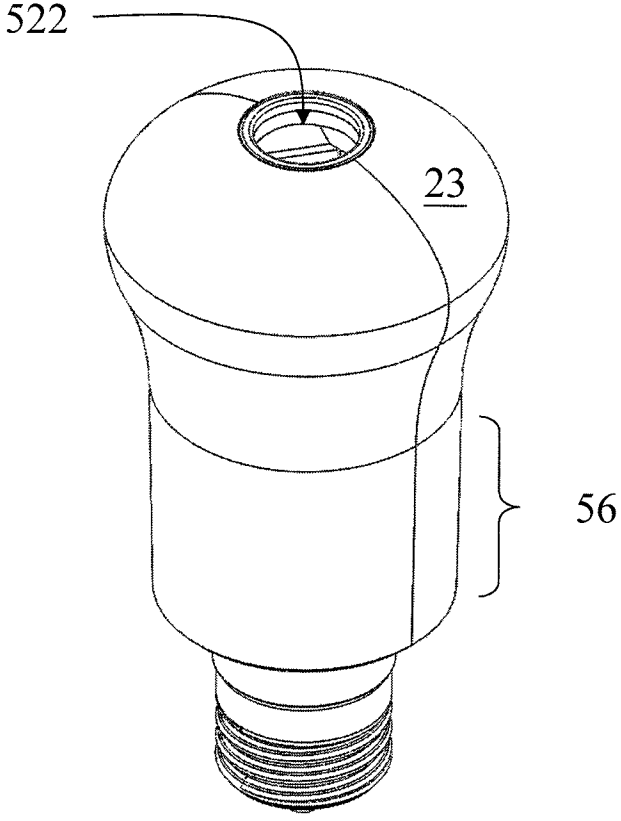
FIG. 22 is a profile of the fifth embodiment.

FIG. 22 is a profile of the fifth embodiment.

FIG. 22 shows the profile of the embodiment of FIG. 19. The transparent dome 23 is configured on the top of the lamp. A top opening 522 is configured on the top of the lamp. A plastic protection layer 56 is coated on the outer surface of the polygon metal tube 501.

Figure 23:
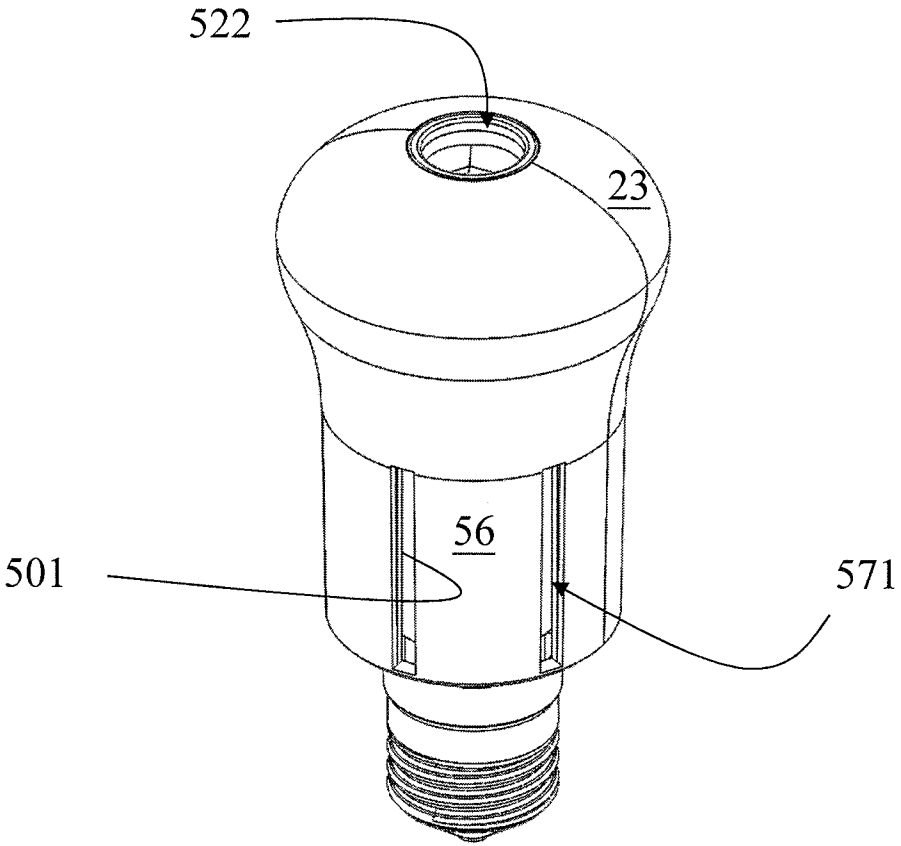
FIG. 23 is side openings made to the fifth embodiment.

FIG. 23 is side openings made to the fifth embodiment.

FIG. 23 shows that a side opening 571 is made through the protection layer 56 and the polygon metal tube 501 to communicate with the circular air passage 551.

While several embodiments have been described by way of example, it will be apparent to those skilled in the art that various modifications may be configured without departing from the spirit of the present invention. Such modifications are all within the scope of the present invention, as defined by the appended claims.

What is claimed is:

1. An air cooling LED lamp, comprising:

a central tube;

a polygon metal tube, enclosing the central tube;

a circular air passage, configured between the polygon metal tube and the central tube;

a flexible circuit board, configured on the outer surface of the polygon metal tube;

an LED, configured on a top surface of the flexible circuit board;

a tapered metal tube, configured on a top of the polygon metal tube;

a top opening, configured on a top of the tapered metal tube; and a bottom opening, configured on a bottom of the polygon metal tube and the central tube;

wherein the circular air passage communicates the top opening and the bottom opening.

2. An air cooling LED lamp as claimed in claim 1, wherein the polygon metal tube has a profile selected from the group consisting of triangle, rectangle, pentagon, and hexagon.

3. An air cooling LED lamp as claimed in claim 1, further comprising:

a tab circuit board, extended from a top of the flexible circuit board; and an LED, configured on a top surface of the tab circuit board;

wherein the tab circuit board is configured on a top surface of the tapered metal tube.

4. An air cooling LED lamp as claimed in claim 1, further comprising:

a controlling circuit board, configured inside the central tube; and an electric wire, electrically coupling the flexible circuit board with the controlling circuit board.

5. An air cooling LED lamp as claimed in claim 4, further comprising:

a first hole, configured on a wall of the polygon metal tube as a passage for the electric wire; and a second hole, configured on a wall of the central tube as a passage for the electric wire.

6. An air cooling LED lamp as claimed in claim 1, further comprising:

a transparent dome, configured on a top of the lamp as a protection.

7. An air cooling LED lamp as claimed in claim 6, wherein the transparent dome is hermetically configured on the top of the lamp.

8. An air cooling LED lamp as claimed in claim 6, wherein a space between the transparent dome and the LED is hermetically formed.

9. An air cooling LED lamp as claimed in claim 1, further comprising:

a protection layer, configured on a lower portion of an outer surface of the polygon metal tube.

10. An air cooling LED lamp as claimed in claim 9, further comprising:

a side opening, extending through the protection layer and the polygon metal tube, wherein the side opening communicates with the circular air passage.

11. An air cooling LED lamp as claimed in claim 1, wherein the circular air passage defines a path for an air flow through the LED lamp, and the path for the air flow extends from an outside of the LED lamp through the bottom opening, upward and around the central tube, then over a top of the central tube, and then through the top opening back to the outside of the LED lamp.

12. An air cooling LED lamp as claimed in claim 1, wherein the circular air passage is defined by a spacing, in a radial direction of the central tube, between an outer surface of the central tube and an inner surface of the polygon metal tube, and the inner surface of the polygon metal tube faces the outer surface of the central tube in the radial direction.

13. An air cooling LED lamp as claimed in claim 1, wherein the bottom opening extends around the central tube.

14. An air cooling LED lamp as claimed in claim 1, further comprising:

a plurality of tab circuit boards arranged side by side and extending from a top of the flexible circuit board; and a plurality of LEDs, configured on top surfaces of the corresponding tab circuit boards;

wherein the tab circuit boards are configured on a top surface of the tapered metal tube.

15. An air cooling LED lamp as claimed in claim 14, wherein each of the tab circuit boards has a shape tapered away from the top of the flexible circuit board.

16. An air cooling LED lamp, comprising:

a central tube;

an outer tube enclosing the central tube;

an air passage between the outer tube and the central tube, the air passage defined by a spacing, in a radial direction of the central tube, between an outer surface of the central tube and an inner surface of the outer tube;

at least one LED arranged on an outer surface of the outer tube;

a tapered metal tube, configured on a top of the outer tube; a top opening, configured on a top of the tapered metal tube; and a bottom opening between a lower portion of the outer tube and a lower portion of the central tube;

wherein the air passage defines a path for an air flow through the LED lamp, and the path for the air flow extends from an outside of the LED lamp through the bottom opening, upward and around the central tube, then over the top of the central tube, and then through the top opening back to the outside of the LED lamp.

17. An air cooling LED lamp as claimed in claim 16, wherein the outer tube is a polygon metal tube.

18. An air cooling LED lamp as claimed in claim 17, further comprising:

a flexible circuit board, configured on the outer surface of the polygon metal tube;

wherein the at least one LED is configured on an outer surface of the flexible circuit board.

19. An air cooling LED lamp as claimed in claim 18, further comprising:

a plurality of tab circuit boards arranged side by side and extending from a top of the flexible circuit board; and at least one LED, configured on a top surface of each of the corresponding tab circuit boards;

wherein the tab circuit boards are configured on a top surface of the tapered metal tube, and each of the tab circuit boards has a shape tapered away from the top of the flexible circuit board.

* * * * *